United States Patent [19]

Derin et al.

[11] Patent Number: 5,070,611

[45] Date of Patent: Dec. 10, 1991

[54] RAZOR AND DISPENSER

[76] Inventors: Stephen Derin; George G. Amir, both of 4200 Wilson Blvd., Arlington, Va. 22203

[21] Appl. No.: 618,620

[22] Filed: Nov. 27, 1990

[51] Int. Cl.[5] ..... B26B 19/44

[52] U.S. Cl. ..... 30/41; 222/402.11

[58] Field of Search ..... 30/41, 86; 222/402.11, 222/402.13

[56] References Cited

U.S. PATENT DOCUMENTS 4,433,483 2/1984 Lazarus ..... 30/41

4,791,723 12/1988 Jacobson ..... 30/41

*Primary Examiner*—Douglas D. Watts

*Attorney, Agent, or Firm*—Dickinson, Wright, Moon, Van Dusen & Freeman

[57] ABSTRACT

An aerosol container is particularly useful for a razor wherein the container serves as part of the handle for the razor. The container includes a combination cap/actuator which dispenses material when depressed. The cap/actuator may be depressed only when placed in a selected rotational position, other rotational positions causing engagement between a shoulder on the container and a skirt on the cap/actuator to prevent depression of the cap/actuator.

10 Claims, 1 Drawing Sheet

RAZOR AND DISPENSER

TECHNICAL FIELD

This invention relates to a pressurized dispenser for materials such as shaving foam. In a preferred embodiment, the dispenser forms a handle for a razor.

BACKGROUND

Aerosol containers for dispensing such materials as shaving foam are well known. It is also known to provide such a container in combination with a razor in such a fashion that the container forms a handle for the razor.

This invention relates to an improvement in the containers used in these razors and in particular the razor shown in U.S. Pat. No. Des. 304,097.

Prior aerosol containers are typically made of metal and employ a valve which includes a stem for dispensing the material when the stem is depressed. An actuator, which directs the flow of the material, engages the stem such that the stem is depressed as the actuator is depressed. The actuator is held to the container by a frictional engagement between the stem and the actuator, and the actuator is removable from the container by pulling it off the stem. Most aerosol containers also provide an overcap which fits over the valve and the actuator to prevent inadvertent depression of the actuator.

This type of container has the general defect that if the actuator is removed, such as for cleaning, the stem is often depressed during reassembly by the downward motion of the actuator due to the frictional engagement between the actuator and the stem. This generally causes the material to be inadvertently dispensed, even if great care is exercised.

SUMMARY OF THE INVENTION

In accordance with the invention, a dispenser consists of a plastic container and a valve with a tubular stem extending away from the container for dispensing the material when the stem is depressed. An integral combination of the overcap and actuator, a "cap/actuator", fits on the container and engages the stem such that the stem is depressed when the cap/actuator is depressed with respect to the container. The cap/actuator receives the stem, however, in such a manner that the stem is not depressed when the cap/actuator is installed on the container. The container has a neck portion which accommodates the valve and provides means for engaging the cap/actuator to hold it to the valve and yet to permit the cap/actuator to be moved with respect to the container to dispense the material held in the container.

In addition, the container has a shoulder which engages the cap/actuator, preferably the skirt portion thereof, to prevent depression of the cap/actuator when the cap/actuator is in a first rotational position and to allow its depression when the cap/actuator has been rotated to a second rotational position. The container includes a stop which engages slots in the cap/actuator to provide positive, "tactile" feel of when the cap/actuator is in either of the first or second rotational positions.

DETAILED DESCRIPTION OF THE INVENTION

Figure 1:
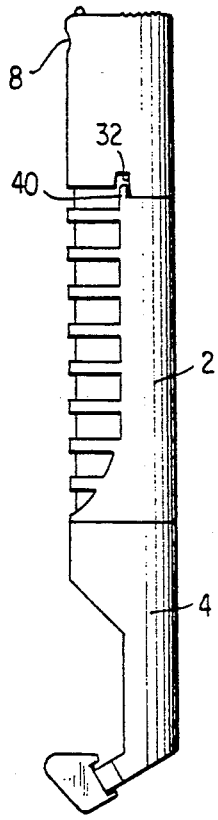
FIG. 1 is a side view of a razor using the container of the invention with the cap/actuator in the first position.
Figure 2:
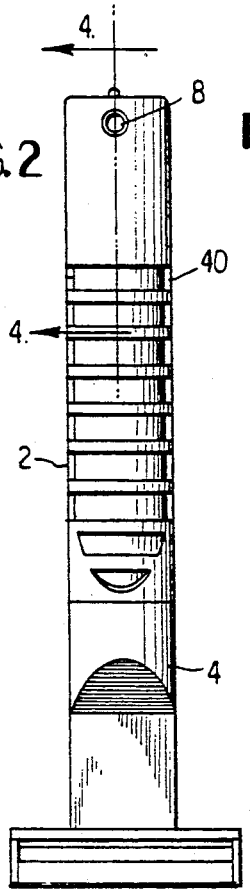
FIG. 2 is a front view of the razor of FIG. 1.

With reference to FIG. 1, a razor includes a container 2, which is attached to a razor head 4 in such a manner that the container serves as a handle when using the razor. A cap/actuator 6 is attached to the container and includes an orifice for dispensing material from the container. In the preferred use of the container, the material is shaving foam.

Figure 4:
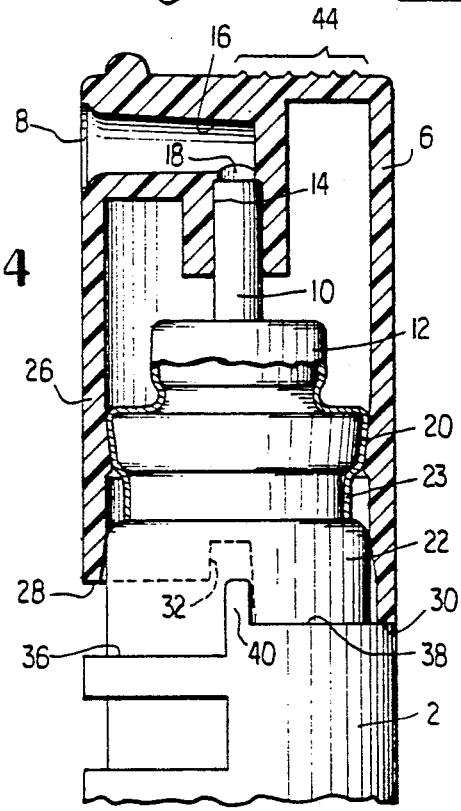
FIG. 4 is a view of the razor as shown in FIGS. 1 and 2 in partial cross section along line 4—4 of FIG. 2.
Figure 5:
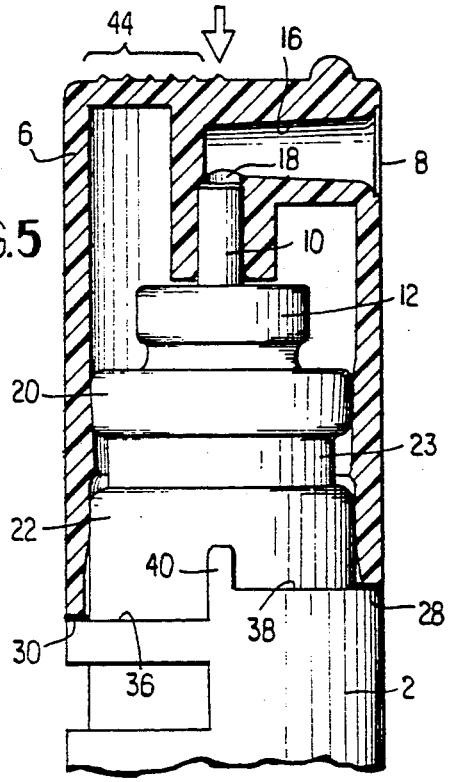
FIG. 5 is a view of the razor as shown in FIG. 3 in partial cross section.

The structure and operation of the container will be described with particular reference to FIGS. 4 and 5. The container includes a valve as known in the art and which includes a stem 10 for releasing the material stored in the container when depressed. The internal structure of valve, which is not illustrated, fits into the neck of the container and is held in place by the mounting cup 12 of the valve. The mounting cup is preferably of metal and includes a skirt which is crimped during manufacture to the neck of the container.

The cap/actuator 6 has a tubular recess 14 which receives stem 10 and communicates with passageway 16 which terminates in orifice 8. The upper end 18 of the tubular recess engages the upper end of the stem to provide a fluid seal such that the material flowing out of the stem does not leak into the area under the cap/actuator and flows through the passageway 16 and the orifice 8.

The diameter of the tubular recess 14, however, is large enough to allow the stem to be slid into the recess without depressing the stem until the upper end of the stem engages the upper end 18 of the recess. Thus, the cap/actuator may be placed on the stem without inadvertently dispensing the material in the container, particularly when the cap/actuator is in the rotational position shown in FIG. 1, as will be more fully described below.

The skirt of the mounting cup 12 of the valve provides a band 20 for engaging the cap/actuator. The band 20 is formed in the skirt of the mounting cup when the valve is secured to the container by crimping, the crimped area being shown at 23. In addition, the container includes a ridge 22 which also engages the cap/actuator. The band 20 engages an inwardly tapered part 24 of the cap/actuator to secure the cap/actuator to the container by providing a force urging the cap/actuator toward the container. The tapered portion 24 is preferably of such a length that it engages the band 20 when the cap/actuator is in its uppermost position as shown in FIG. 4 and this engagement is relaxed when the cap/actuator is in its depressed position as shown in FIG. 5. Thus, the interaction between the band and the tapered portion urges the cap/actuator slightly downward to hold it to the container.

The skirt 26 of the cap/actuator is stepped an includes an upper step 28 and a lower step 30. The upper step extends over the majority of one-half of the circumference of the cap/actuator and the lower step extends over the majority of the remainder of the circumference. Notches 32 and 34 are located between the steps for a purpose to be described below.

The container includes a first shoulder 36 and a second shoulder 38. The first shoulder is below the second shoulder and is spaced by a distance which represents the amount by which the stem of the valve must be depressed to dispense the material from the container. The shoulders interact with the steps of the cap/actuator skirt such that the second shoulder 38 engages the upper step 30 when the cap/actuator is in the rotational position shown in FIGS. 1 and 4 to prevent inadvertent depression of the cap. When the cap/actuator is rotated to the position shown in FIGS. 3 and 5, however, the upper step 28 is aligned with the second shoulder 38 and the lower step 30 is aligned with the first shoulder 36. The cap/actuator may then be depressed as shown in FIG. 5, whereby the stem 10 is depressed, and the material is dispensed.

The upper end of the container includes a stop 40 which engages the sides of the cap/actuator skirt adjacent to the lower step 30 when the cap/actuator is in the first and second rotational positions. That is, the stop engages the side of the step when the cap/actuator is in the rotational position shown in FIG. 1 to prevent clockwise rotation (when viewed from the upper end of FIG. 1) of the cap/actuator 10 and to allow counterclockwise rotation. Similarly, the stop permits clockwise rotation from the rotational position shown in FIG. 3 while preventing counterclockwise rotation. Thus, the cap/actuator may be rotated by a single "twist" from the rotational position shown in FIG. 1 to the rotational position shown in FIG. 3 to permit dispensing of the material in the container and returned to the rotational position shown in FIG. 1 by a single "twist" in the opposite direction to prevent inadvertent dispensing of the material.

Figure 3:
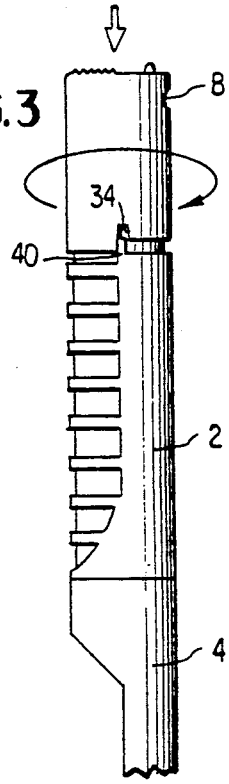
FIG. 3 is a side view of the razor of FIG. 1 with the cap/actuator rotated to the second position.

The stop 40 extends slightly beyond the upper step 28 so that the cap/actuator must be lifted slightly as it is rotated between the rotational position shown in FIG. 1 to that shown in FIG. 3. The interaction between the band 20 and the tapered part 24, which urges the cap/actuator in a downward direction, causes the cap/actuator to "snap" slightly downward when it reaches either the rotational position shown in FIG. 1 or the rotational position shown in FIG. 3.

The cap/actuator 10 includes thumb grips 44 and an index element 46 which indicates the position of the orifice 8 to the user when viewed from the upper end of the razor.

The container is preferably made of polyethylene terephthalate (P.E.T.). This composition has been found to have the advantage that materials such as shaving foams will not leak, many other known plastic compositions being permeable to these foams and being unsuitable.

Modifications within the scope of the appended claims will be apparent to those of skill in the art.

I claim:

1. A dispenser comprising container means for containing material to be dispensed, valve means, and cap/actuator means for engaging said container means and for directing the flow of said material when dispensed, wherein:

said container comprises means for engaging said cap/actuator and said dispensing valve means includes a stem which is movable in a direction to dispense said material, said cap/actuator comprises means for receiving said stem and skirt means for engaging said container, said means for engaging said cap/actuator holds said cap/actuator to said container in a first longitudinal position of said cap/actuator and allows said cap/actuator to move in said direction to a second longitudinal position, and said means for receiving said stem comprises means for moving said stem in said direction only after said cap/actuator is in said first longitudinal position, said means for receiving comprises a tubular opening having an end for sealingly engaging an end of said stem when said cap/actuator is in said first position and wherein said tubular opening allows said stem to slide therein without movement of said stem until said end of said stem engages said end of said tubular opening, said container includes a shoulder for engaging said skirt and preventing movement of said cap/actuator from said first longitudinal position to said second longitudinal position when said cap/actuator is in a first rotational position, said shoulder permits movement of said cap/actuator from said first longitudinal position to said second longitudinal position when said cap/actuator is in a second rotational position, and wherein said container further comprises a stop for preventing rotation of said cap/actuator in a first rotational direction and for permitting rotation of said cap/actuator in a second rotational direction from said first rotational position to said second rotational position and for preventing rotation in said second direction beyond said second rotational position.

2. Apparatus comprising a body, a cap covering one end of said body, securing means for securing said cap to said body and for allowing longitudinal and rotational movement of said cap with respect to said body, and stop means for preventing rotation of said cap in a first direction from a first rotational position, permitting rotation of said cap in a second direction from said first rotational position to a second rotational position, preventing further rotation of said cap in said second direction from said second position, and resisting rotation of said cap from said first rotational position.

3. Apparatus according to claim 2 wherein said securing means resiliently urges said cap in a first longitudinal direction and said stop means moves said cap in a second longitudinal direction from a first longitudinal position during rotation of said cap between said first and second rotational positions and permits said cap to return to said first longitudinal position when said cap is in said first rotational position.

4. Apparatus according to claim 3 wherein said securing means comprises a band on said body and a tapered portion of said cap in contact with said band.

5. Apparatus according to claim 4 wherein said tapered portion of said cap is made of resilient material.

6. Apparatus according to claim 5 wherein said stop means comprises a projection on said body which engages a first edge of a first skirt of said cap when said cap is in said first rotational position and a second edge of said first skirt when said cap is in said second rotational position, and said cap further includes a second skirt which engages said projection to move said cap from said first longitudinal position.

7. Apparatus according to claim 6 wherein said body comprises a container and a dispensing valve for dispensing the contents of said container and said cap comprises actuating means for engaging said dispensing valve and opening said dispensing valve during movement of said cap in said longitudinal direction toward an opposite end of said container.

8. Apparatus according to claim 7 wherein said body comprises a step engaged by said first skirt when said cap is in said first rotational position to prevent movement of said cap in said longitudinal direction toward said opposite end of said container.

9. Apparatus according to claim 5 wherein a bottom part of said tapered portion of said cap is of smaller diameter than an upper portion of said band whereby said cap must be forced outward to allow said tapered portion of said cap to pass over said band.

10. Apparatus according to claim 9 wherein said band includes tapered sides which engage said tapered portion of said cap.

* * * * *